US008967830B1

(12) United States Patent
Winfrey

(10) Patent No.: US 8,967,830 B1
(45) Date of Patent: Mar. 3, 2015

(54) HOLIDAY HOOP DECOR SYSTEMS

(71) Applicant: Scott Winfrey, Canton, MI (US)
(72) Inventor: Scott Winfrey, Canton, MI (US)

( * ) Notice: Subject to any disclaimer, the term of this patent is extended or adjusted under 35 U.S.C. 154(b) by 164 days.

(21) Appl. No.: 13/795,049
(22) Filed: Mar. 12, 2013

Related U.S. Application Data

(60) Provisional application No. 61/611,963, filed on Mar. 16, 2012.

(51) Int. Cl.

| | |
|---|---|
| ***F21S 4/00*** | (2006.01) |
| ***F21V 21/00*** | (2006.01) |
| ***F21S 8/00*** | (2006.01) |
| ***A47G 33/00*** | (2006.01) |
| ***F21V 21/116*** | (2006.01) |
| *A63B 63/08* | (2006.01) |
| *F21W 121/00* | (2006.01) |

(52) U.S. Cl.
CPC ..... *A47G 33/00* (2013.01); *F21V 21/116* (2013.01); *A63B 2207/02* (2013.01); *A63B 63/083* (2013.01); *F21W 2121/00* (2013.01)
USPC ..... 362/249.06; 362/145; 362/427

(58) Field of Classification Search
CPC A63B 63/083; A63B 2207/02; F21V 21/116; F21W 2121/00; Y10S 362/806
USPC ..... 362/145, 236, 239, 384, 405, 406, 418, 362/419, 421, 427, 428, 457, 458, 806, 362/808; 473/479
See application file for complete search history.

(56) References Cited

U.S. PATENT DOCUMENTS

| | | | | |
|---|---|---|---|---|
| 4,298,907 | A * | 11/1981 | Holt, Jr. | 362/4 |
| 4,363,084 | A * | 12/1982 | Dimiceli | 362/249.01 |
| 5,711,727 | A | 1/1998 | Edge et al. | |
| 6,196,938 | B1 | 3/2001 | Wiedner | |
| D447,195 | S | 8/2001 | Wiedner et al. | |
| 6,284,330 | B1 * | 9/2001 | Hermanson | 428/9 |
| 6,468,373 | B1 | 10/2002 | Grinwald et al. | |
| 6,769,793 | B2 * | 8/2004 | Hornsby et al. | 362/352 |
| 7,086,189 | B2 | 8/2006 | Morris et al. | |
| 2003/0137847 | A1 * | 7/2003 | Cooper | 362/418 |
| 2007/0225092 | A1 * | 9/2007 | Watson et al. | 473/481 |
| 2010/0298075 | A1 | 11/2010 | Paslay et al. | |

* cited by examiner

*Primary Examiner* — Jong-Suk (James) Lee
*Assistant Examiner* — Alexander Garlen
(74) *Attorney, Agent, or Firm* — RG Patent Consulting LLC; Rachel Gilboy

(57) ABSTRACT

Holiday Hoop Décor Systems provides a novel retrofittable décor-cover frame assembly which may be installed to a backboard of a basketball hoop. The décor-cover frame has a pair of adjustable arm members and a head member. At a distal end of each of the arms a light panel comprising LEDs is illuminable by activating a control switch. A décor-cover having a holiday or seasonal display appearance may be placed around the décor-cover frame assembly.

20 Claims, 7 Drawing Sheets

HOLIDAY HOOP DECOR SYSTEMS

CROSS-REFERENCE TO RELATED APPLICATION

The present application is related to and claims priority from prior provisional application Ser. No. 61/611,963, filed Mar. 16, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of basketball hoop decoration assemblies and more specifically relates to a holiday hoop décor system comprising a décor support and lighting frame assembly which may be removably installable to a backboard of a basketball hoop for displaying a décor cover comprising a holiday or seasonal display.

2. Description of the Related Art

Many households have a basketball hoop of some sort, whether it has a stand or is mounted on a roof. Unfortunately, many of these basketball hoops are no longer in use, serve no functional purpose, and are simply an eyesore. Other basketball hoops go for an entire season without use because they cannot be used in the winter months. Many decorations may not fold up for compact storage, making them difficult to store when not in use. Individuals who enjoy decorating for the holidays are always looking for new and creative methods of expressing their holiday spirit, and would benefit from a product that allows them to transform any basketball hoop into a king size, outdoor decoration.

Various attempts have been made to solve the above-mentioned problems such as those found in U.S. Pat. No. 7,086,189 to James M. Morris et al; U.S. Pat. No. 6,196,938 to Mark C. Wiedner; 2010/0298075 to David L. Paslay et al; U.S. Pat. No. 6,468,373 to Anthony G. Grinwald et al; U.S. Pat. No. 5,711,727 to Andre L. Edge et al; and D447,195 to Mark C. Wiedner et al. This prior art is representative of decorative hoop displays. None of the above inventions and patents, taken either singly or in combination, is seen to describe the invention as claimed.

Ideally, a holiday hoop décor system should provide a frame assembly which may be removably installable to a backboard of a basketball hoop for displaying a thematic display. Thus, a need exists for a reliable holiday hoop décor system to avoid the above-mentioned problems.

BRIEF SUMMARY OF THE INVENTION

In view of the foregoing disadvantages inherent in the known hoop décor art, the present invention provides a novel holiday hoop décor system comprising a décor support and lighting frame assembly and a cover assembly for transforming virtually any type of basketball hoop into a lighted holiday-themed decoration. The holiday hoop décor system comprises a frame and decorative cover to provide a king-size decoration to any home with a basketball hoop. The ease of the holiday hoop décor system makes it possible to install and take down in minutes a giant-sized decoration, allowing individuals to swap decorations often, or still use the basketball hoop for recreation in-between holidays. When not in use, the holiday hoop décor system may fold down easily for compact storage. The holiday hoop décor system may serve to eliminate the eyesore from any basketball hoop in a yard, especially those that are no longer in use, while offering up enthusiastic and enjoyable decorations everyone can appreciate. Individuals who love to decorate may appreciate the holiday spirit the holiday hoop décor system provides A holiday hoop décor system for use with a backboard of a basketball hoop in a preferred embodiment may comprise a décor support and lighting frame assembly and a cover assembly. The décor support and lighting frame assembly may comprise a first-arm member, a second-arm member, a head member, a center bar, a first-frame support, a second-frame support, a plurality of electrical wires, a power plug, and a control switch. The first-arm member may comprise a first-arm member disc comprising opaque plastic, a first-arm member light panel including at least one LED having a clear plastic lens, a first-arm member "T" connector, and a first-arm member pivoter. The second-arm member may comprise a second-arm member disc comprising opaque plastic, a second-arm member light panel including the at least one LED having the clear plastic lens, a second-arm member "T" connector, and a second-arm member pivoter. The head member may comprise a head member disc comprising opaque plastic, a head member light panel including the at least one LED having the clear plastic lens, and a head member "T" connector. The center bar may have a first-end, a mid-point, and a second-end. The first-frame support may comprise padding and may have a first-distal end and a first-proximal end. The first-frame support may further comprise a first-frame support retaining strap and a first-frame support retaining strap receiver. The second-frame support may comprise padding having a second-distal end and a second-proximal end. The second-frame support may further comprise a second-frame support retaining strap and a second-frame support retaining strap receiver. The power plug may plug into an electric outlet for providing power to the system, and the control switch may be activated by a user for turning on the system.

The cover assembly may comprise a décor-cover formed of rip-stop nylon, and a plurality of fasteners for securing the décor-cover to the décor support and lighting frame assembly once installed to the backboard of the basketball hoop.

With reference to the first-arm member, there is a first-disc-receiving end and a first-connecting end. The first-disc-receiving end of the first-arm member also comprises a first-groove which is slidable into a first-receiving slot of said first-arm member disc. The first-receiving slot further comprises a nipple which may serve to guide the first-groove of the first-arm member into the first-receiving slot of the first-arm member disc. The first-arm member disc is lockable and unlockable in place via a clockwise rotation and a counter-clockwise rotation about the nipple respectively. The first-arm member light panel is integrally installed within a hollow confine of the first-arm member near the first-disc-receiving end. The first-arm member pivots upwardly approximately 50-60 degrees via the first-arm member pivoter for orienting the first-arm member disc to simulate an appearance of a raised left arm of the décor-cover. The first-arm member light panel illuminates the décor-cover for simulating a glow around the raised left-arm. The first-connecting end of the first-arm member is connectible to the first-end of the center bar via the first-arm member "T" connector. The first-arm member pivoter enables the first-arm member to pivot left and right about an axis With reference to the second-arm member, there is a second-disc-receiving end and a second-connecting end. The second-disc-receiving end of the second-arm member also comprises a second-groove which is slidable into a second-receiving slot of said second-arm member disc. The second-receiving slot further comprises the nipple which may serve to guide the second-groove of the second-arm member into the second-receiving slot of the second-arm member disc, similar to the first-arm member. The second-arm member disc is lockable and unlockable in place via a clockwise rotation and a counter-clockwise rotation about the nipple respectively. The second-arm member light panel is integrally installed within a hollow confine of the second-arm member near the second-disc-receiving end. The second-arm member pivots upwardly approximately 50-60 degrees via the second-arm member pivoter for orienting the second-arm member disc to simulate an appearance of a raised right arm of the décor-cover. The second-arm member light panel illuminates the décor-cover for simulating a glow around the raised left-arm. The second-connecting end of the second-arm member is connectible to the second-end of the center bar via the second-arm member "T" connector. The second-arm member pivoter enables the second-arm member to pivot left and right about an axis.

With reference to the head member, there is a head-disc-receiving end and a head-connecting end. The head-disc-receiving end of the head member also comprises a head-groove which is slidable into a head-receiving slot of said head member disc. The head-receiving slot further comprises the nipple which may serve to guide the head-groove of the head member into the head-receiving slot of the head member disc, similar to the first-arm member and second-arm member. The head member disc is lockable and unlockable in place via a clockwise rotation and a counter-clockwise rotation about the nipple respectively. The head member light panel is integrally installed within a hollow confine of the head member near the head-disc-receiving end. The head member light panel illuminates the décor-cover for simulating a glow around a head area. The head-connecting end of the head member is connectible to the mid-point of the center bar via the head member "T" connector.

For assembly, the first-proximal end of the first-frame support is connectible to the first-arm member "T" connector such that the first-frame support is perpendicular to the center bar. The first-frame support retaining strap is attached to the first-distal end of the first-frame support. The first-frame support retaining strap receiver is attached to the first-arm member "T" connector such that the first-frame support retaining strap receiver is substantially parallel to the first-frame support. The second-proximal end of the second-frame support is connectible to the second-arm member "T" connector such that the second-frame support is perpendicular to the center bar. The second-frame support retaining strap is attached to the second-distal end of the second-frame support. The second-frame support retaining strap receiver is attached to the second-arm member "T" connector such that the second-frame support retaining strap receiver is substantially parallel to the second-frame support.

To power the system, the plurality of electrical wires may connect the power plug to the first-arm member light panel, the second-arm member light panel, and the head member light panel. Further, the control switch is provided for activating the power plug, and the power plug serves to provide illuminating power to the first-arm member light panel, the second-arm member light panel, and the head member light panel. The first-arm member light panel, the second-arm member light panel, and the head member light panel each comprises at least one LED having a clear plastic lens. Preferably, the first-arm member disc, the second-arm member disc, and the head member disc are formed of opaque plastic and the décor support and lighting frame assembly is installable to the backboard of the existing basketball hoop via the first-frame support and the second-frame support.

The holiday hoop décor system may comprise a kit which may include at least one the décor support and lighting frame assembly and at least one the cover assembly. It should be noted that the décor cover of the cover assembly may take a variety of forms, such as Santa Clause, Uncle Sam, Easter Bunny, a Halloween figure, and many more.

A method of use for a holiday hoop décor system may comprise the steps of installing a décor support and lighting frame assembly to a backboard of a basketball hoop, adjusting a first-arm member and a second-arm member of the décor support and lighting frame assembly, placing a décor cover over the décor support and lighting frame, and activating a control switch for illumination.

The present invention holds significant improvements and serves as a holiday hoop décor system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, holiday hoop décor systems, constructed and operative according to the teachings of the present invention

The various embodiments of the present invention will hereinafter be described in conjunction with the appended drawings, wherein like designations denote like elements.

DETAILED DESCRIPTION

As discussed above, embodiments of the present invention relate to a holiday hoop décor system and more particularly to a frame assembly and a specially designed cover which may be used in conjunction with a basketball hoop for providing a novel holiday and seasonal display.

Generally speaking, the holiday hoop décor system may comprise a decorative frame and cover that transforms a basketball hoop into a themed holiday decoration. The holiday hoop décor system may comprise two distinct parts: the frame, and the decorative cover. The frame may be constructed from heavy-duty light-weight plastic, approximately ¾" thick, and features two "arms" and a "head" which can lock into three discs at the ends constructed from opaque plastic. The poles of the head and arms located inside the discs can have an area containing LED lights, with panels available for opening and changing bulbs when necessary. Two sets of "forks" allow the frame to fit securely over the backboard, and are padded to prevent damage to the backboard. The pole that connects the two arms can also be well padded, and positioned slightly in front of the forks to allow fan-shaped backboards to fit through the frame and rest on the well-padded elbows that connect the two front and back forks. Elastic-type bands can be attached to the end of the forks, and can be pulled tightly under and around the backboard and secured, either via hook-and-loop fasteners or a locking mechanism, in order to keep the entire frame snug around the backboard. An electrical plug can extend out from the center of the horizontal pole attached to the head, which when plugged in can light the three LED lights in the head and hands. When not in use, the arm poles fold up for compact storage.

Figure 1:
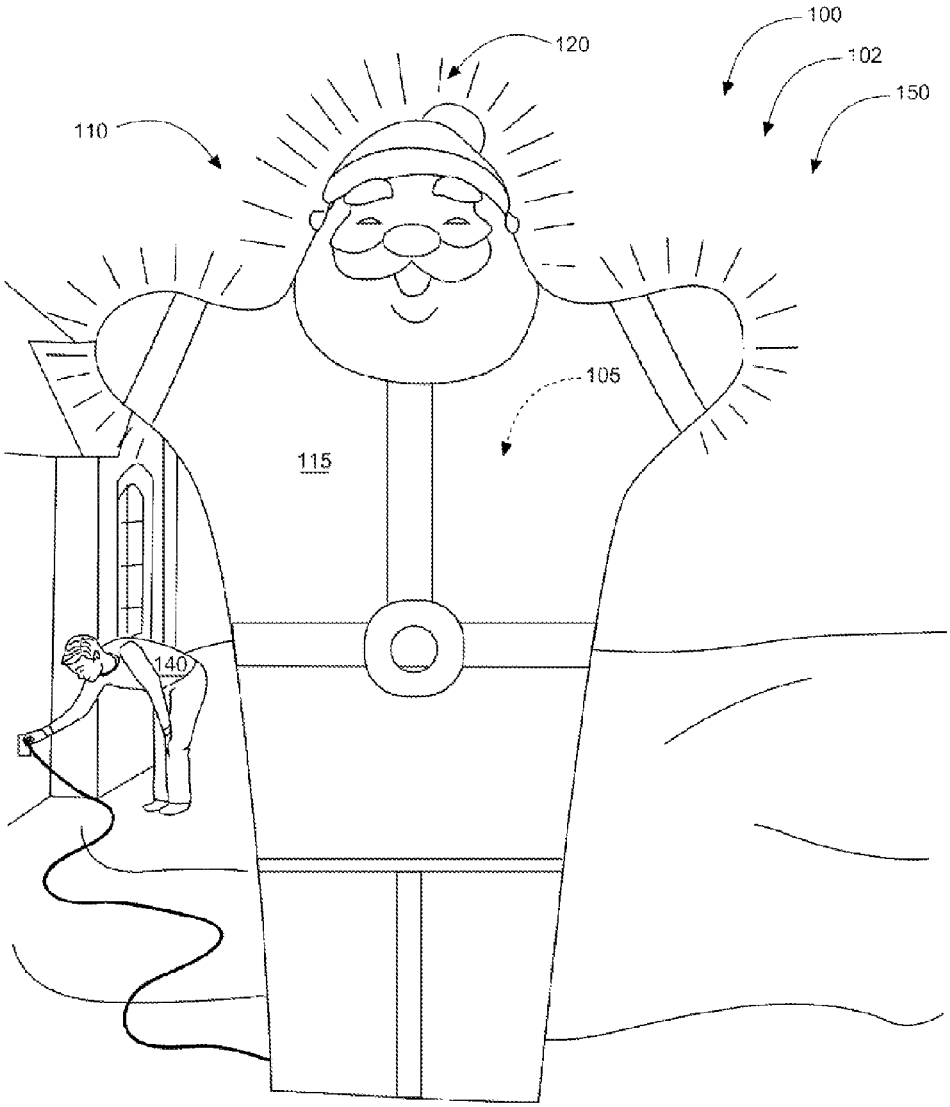
FIG. 1 shows a perspective view illustrating a holiday hoop décor system during an 'in-use' condition comprising a décor cover which is positioned over a décor support and lighting frame assembly installed to a backboard of a basketball hoop according to an embodiment of the present invention.

Referring now to the drawings by numerals of reference there is shown in FIG. 1, holiday hoop décor system 100 during 'in-use' condition 150 according to an embodiment of the present invention.

As shown, holiday hoop décor system 100 may comprise décor support and lighting frame assembly 102 and cover assembly 110. As shown, décor support and lighting frame assembly 102 may be installed to basketball hoop 105 that is in-ground on a driveway of a private residence. Décor cover 115 of cover assembly 110 may be placed around décor support and lighting frame assembly 102 and secured thereto via a plurality of fasteners. Once installed and décor cover 115 is in position, user 140 may plug in power plug 175 into an electric outlet and activate control switch 280 (shown in FIG. 2) for causing illumination 120 to glow from a head and arm region of décor cover 115. This may provide an aesthetically pleasing visual effect during the night.

In a preferred embodiment, décor cover 115 may comprise rip-stop nylon. This may provide for longer use of décor cover 115 by protecting against accident tearing and weather damage. Alternatively, décor cover 115 may comprise plastic, vinyl, or other light-weight, flexible material.

Figure 2:
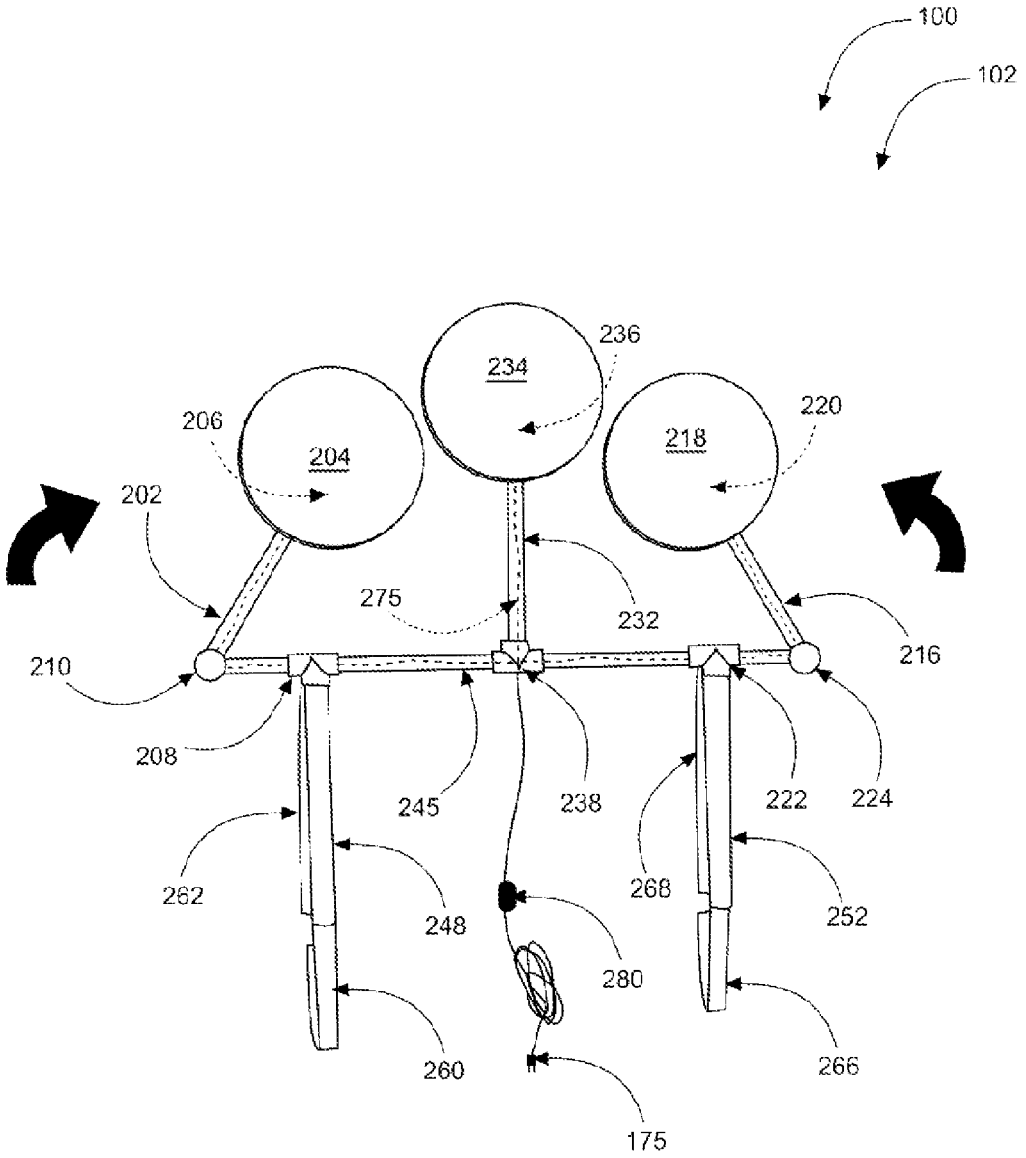
FIG. 2 is a perspective view of the décor support and lighting frame assembly of the holiday hoop décor system according to an embodiment of the present invention of FIG. 1.

Referring now to FIG. 2, illustrating a perspective view of décor support and lighting frame assembly 102 of holiday hoop décor systems 100 according to an embodiment of the present invention of FIG. 1. As shown, décor support and lighting frame assembly 102 may comprise first-arm member 202, second-arm member 216, head member 232, center bar 245 having a first-end, a mid-point, and a second-end, first-frame support 248 having a first-distal end and a first-proximal end, second-frame support 252 having a second-distal end and a second-proximal end, first-frame support retaining strap 260, first-frame support retaining strap receiver 262, second-frame support retaining strap 266, second-frame support retaining strap receiver 268, electrical wires 275, power plug 175, and control switch 280. First-arm member 202 comprises first-arm member disc 204, first-arm member light panel 206, first-arm member "T" connector 208, and first-arm member pivoter 210. Second-arm member 216 comprises second-arm member disc 218, second-arm member light panel 220, second-arm member "T" connector 222, and second-arm member pivoter 224. Head member 232 comprises head member disc 234, head member light panel 236, and head member "T" connector 238. It should be noted that first-arm member light panel 206, second-arm member light panel 220, and head member light panel 236 are hidden within a confine of first-arm member disc 204, second-arm member disc 218, and head member disc 234 respectively.

In one embodiment, décor support and lighting frame assembly 102 of holiday hoop décor systems 100 may be manufactured of high-grade, light-weight plastic. In alternative embodiments, décor support and lighting frame assembly 102 may be manufactured of a ferrous material.

In a preferred embodiment, first-arm member disc 204, second-arm member disc 218, and head member disc 234 are formed of opaque plastic. In such a manner, light emitted from first-arm member light panel 206, second-arm member light panel 220, and head member light panel 236 may provide illumination 120 which may provide a glow-like appearance of décor-cover 115.

In still referring to FIG. 2, electrical wires 275 connects power plug 175 to first-arm member light panel 206, second-arm member light panel 220, and head member light panel 236. Control switch 280 activates power plug 175 and power plug 175 provides illuminating power to first-arm member light panel 206, second-arm member light panel 220, and head member light panel 236 when control switch 280 is activated by user 140, as shown best in FIG. 1.

Figure 3:
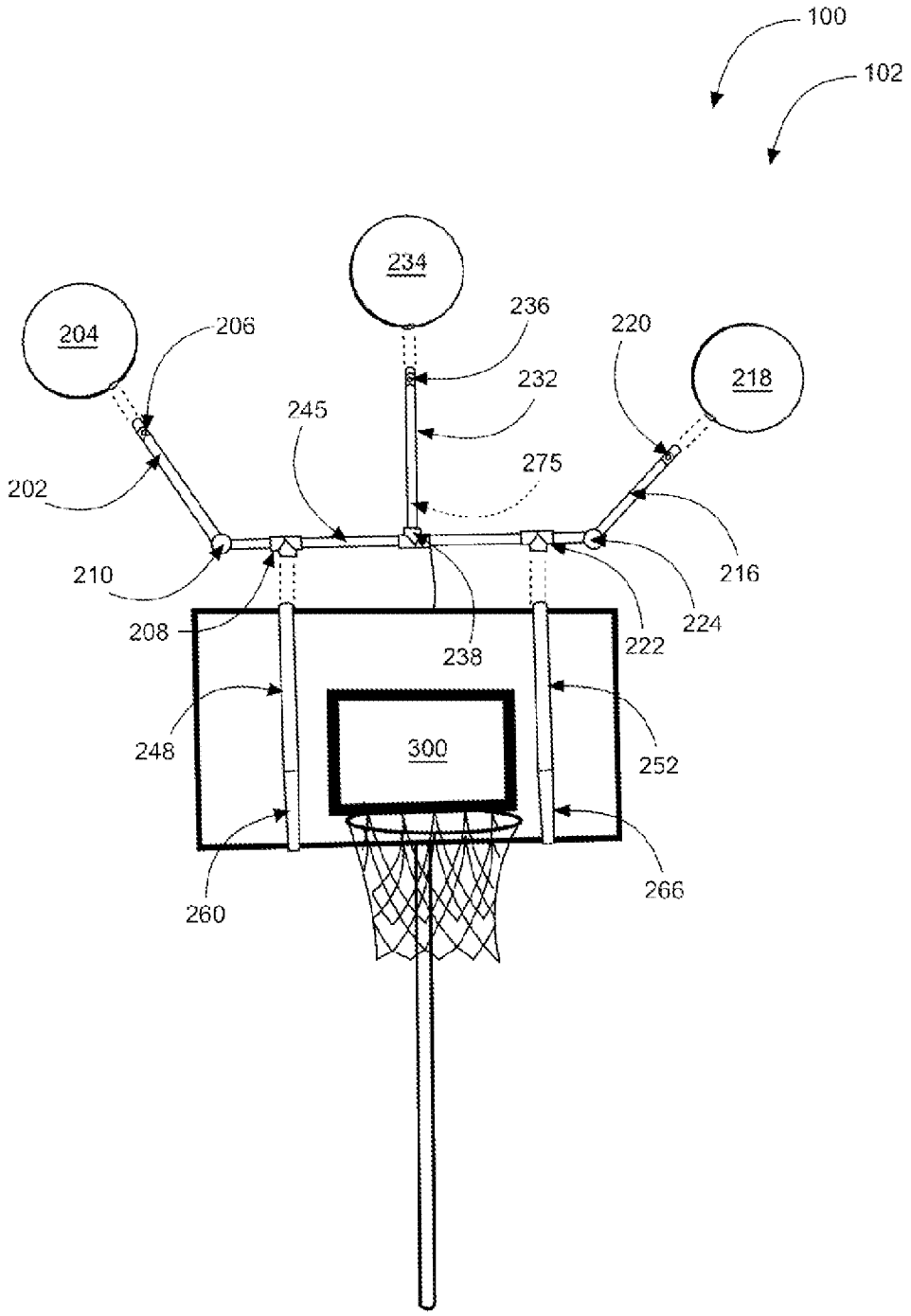
FIG. 3 is an exploded view of the décor support and lighting frame assembly of the holiday hoop décor system according to an embodiment of the present invention of FIGS. 1-2.

Referring now to FIG. 3, illustrating an exploded view of décor support and lighting frame assembly 102 of holiday hoop décor systems 100 according to an embodiment of the present invention of FIGS. 1-2.

First-arm member 202 has a first-disc-receiving end and a first-connecting end. The first-disc-receiving end of first-arm member 202 may comprise groove 410 which is slidable into receiving slot 405 of first-arm member disc 204. As shown, first-arm member light panel 206 may be integrally installed within a hollow confine of first-arm member 202 near the first-disc-receiving end. The first-connecting end of first-arm member 202 is connectible to the first-end of center bar 245 via first-arm member "T" connector 208. First-arm member pivoter 210 enables first-arm member 202 to pivot left and right about an axis. In a preferred embodiment, first-arm member 202 may pivot upwardly approximately 50-60 degrees via first-arm member pivoter 210 for orienting first-arm member disc 204 to simulate an appearance of a raised left arm of décor-cover 115. Furthermore, first-arm member light panel 206 illuminates décor-cover 115 for simulating a glow around the raised left-arm.

In continuing to refer to FIG. 3, second-arm member 216 has a second-disc-receiving end and a second-connecting end. The second-disc-receiving end of second-arm member 216 comprises groove 410 which is slidable into receiving slot 405 of second-arm member disc 218. Second-arm member light panel may be integrally installed within a hollow confine of second-arm member 216 near the second-disc-receiving end. The second-connecting end of second-arm member 216 is connectible to the second-end of center bar via second-arm member "T" connector 222. Second-arm member pivoter 224 enables second-arm member 216 to pivot left and right about an axis. In a preferred embodiment, second-arm member 216 may pivot upwardly approximately 50-60 degrees via second-arm member pivoter 224 for orienting second-arm member disc 218 to simulate an appearance of a raised right arm of décor-cover 115. Furthermore, second-arm member light panel 220 illuminates décor-cover 115 for simulating a glow around the raised right-arm.

In still referring to FIG. 3, head member 232 may comprise a head-disc-receiving end and a head-connecting end. The head-disc-receiving end of head member 232 comprises groove 410 which may be slidable into receiving slot 405 of head member disc 234. Head member light panel 236 may be integrally installed within a hollow confine of head member 232 near the head-disc-receiving end. The head-connecting end of head member 232 is connectible to the mid-point of center bar 245 via head member "T" connector 238. As further shown, electrical wires 275 may run internally within first-arm member 202, second-arm member 216, and head member 232 for providing electrical power from power plug 175 to first-arm member light panel 206, second-arm member light panel 220, and head member light panel 236.

The first-proximal end of first-frame support 248 is connectible to first-arm member "T" connector 208 such that first-frame support 248 is perpendicular to center bar 245. First-frame support retaining strap 260 is attached to the first-distal end of first-frame support 248. Further, first-frame support retaining strap receiver 262 is attached to first-arm member "T" connector 208 such that first-frame support retaining strap receiver 262 is substantially parallel to first-frame support 248.

In continuing to refer to FIG. 3, the second-proximal end of second-frame support 252 is connectible to second-arm member "T" connector 222 such that second-frame support 252 is perpendicular to center bar 245. Second-frame support retaining strap 266 is attached to the second-distal end of second-frame support 252. Second-frame support retaining strap receiver 268 is attached to second-arm member "T" connector 222 such that second-frame support retaining strap receiver 268 is substantially parallel to second-frame support 252.

It should be appreciated that in a preferred embodiment of holiday hoop décor systems 100, first-frame support 248 and second-frame support 252 of décor support and lighting frame assembly 102 may comprise padding for protecting backboard 300 from abrasive contact when installed. The padding may comprise foam or felt material which may be securely wrapped around first-frame support 248 and second-frame support 252.

It should be noted that when not in use, décor support and lighting frame assembly 102 is collapsible for easy storage. To collapse, simply fold inward first-arm member 202 via first-arm member pivoter 210 and second-arm member 216 via second-arm member pivoter 224. Further, first-arm member disc 204, second-arm member disc 218, and head member disc 234 may be removed from first-arm member 202, second-arm member 216, and head member 232 respectively further enhancing the compactness of holiday hoop décor systems 100 for storage.

Figure 4A:
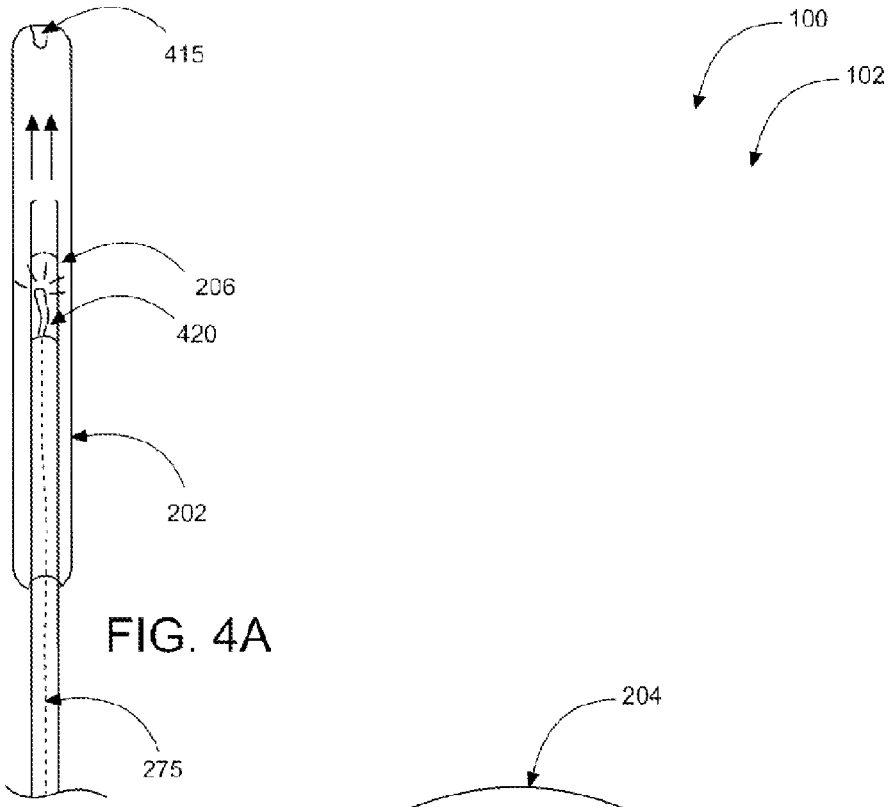
FIGS. 4A and 4B are close-up perspective views illustrating a top angle and a side angle of a first-arm member comprising a first-arm member light panel which may be slidably insertable into a first-arm member disc according to an embodiment of the present invention of FIG. 1.

Referring now to FIG. 4A showing a close-up perspective view of a top angle of first-arm member 202 comprising first-arm member light panel 206 which may be slidably insertable into first-arm member disc 204 according to an embodiment of the present invention of FIG. 1. As shown, first-arm member light panel 206 is integrally installed within a hollow confine of first-arm member 202 near the first-disc-receiving end. Further, the first-disc-receiving end of first-arm member 202 is insertable into receiving slot 405 of first-arm member disc 204. First-arm member disc 204 may comprise nipple 415 which may comprise a tiny bump within groove 410 (as better shown in FIG. 4B). First-arm member 202 is lockable and unlockable in place via a clockwise rotation and a counter-clockwise rotation of first-arm member disc 204 about nipple 415. It should further be noted that FIG. 4A shows first-arm member 202 by means of example and that second-arm member 216 and head member 232 operate exactly the same.

Figure 4B:
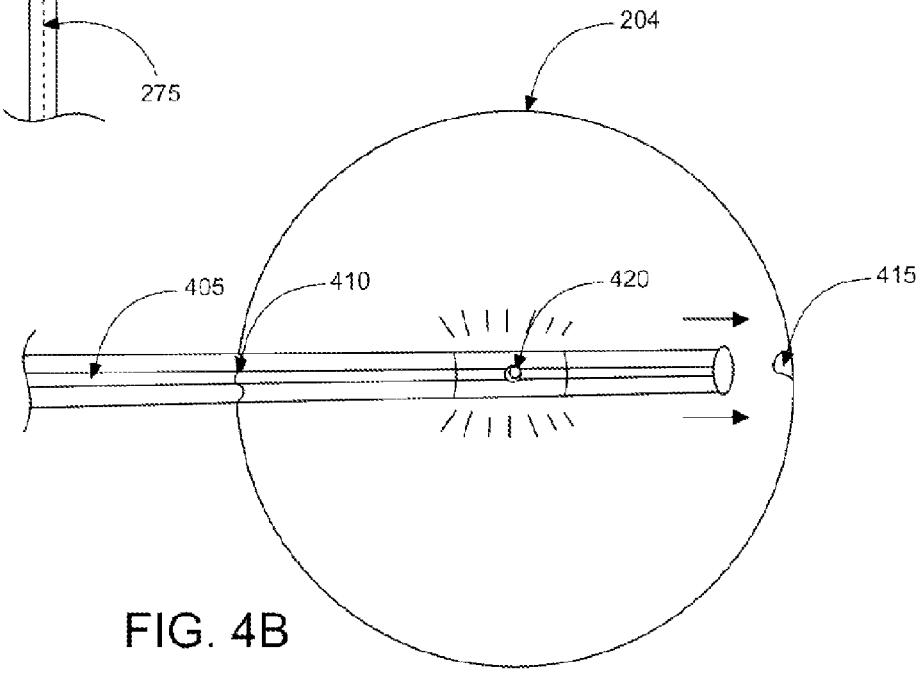

Referring now to FIG. 4B showing a close-up perspective view of a side angle of first-arm member 202 according to an embodiment of the present invention of FIG. 1. As may be seen, first-arm member disc 204 may comprise receiving slot 405 and the first-disc-receiving end of first-arm member 202 comprises groove 410 which may fit within receiving slot 405. As may further be seen, nipple 415 may serve to guide groove 410 of first-arm member 202 into receiving slot 405 of first-arm member disc 204. It should further be noted that FIG. 4B shows first-arm member 202 by means of example and that second-arm member 216 and head member 232 operate exactly the same.

Figure 5:
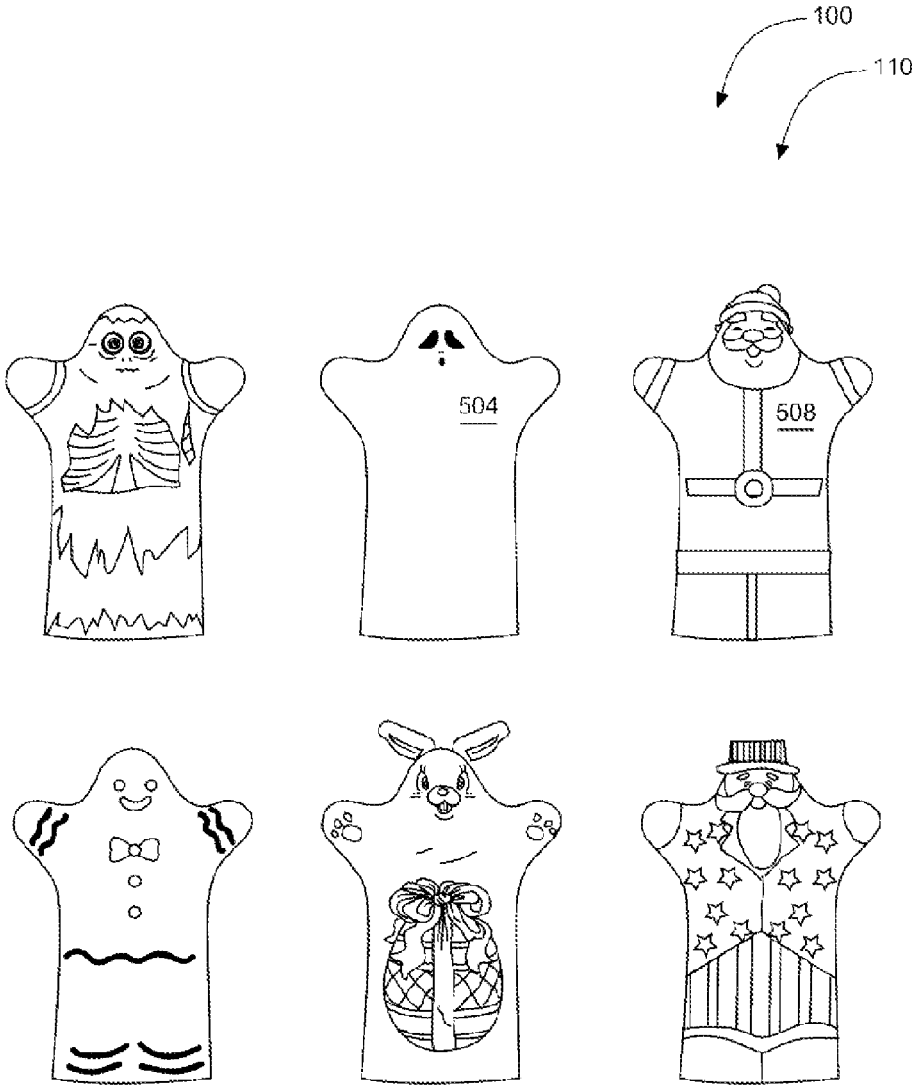
FIG. 5 shows various designs of a décor cover such as a holiday character or a seasonal display of the holiday hoop décor system according to an embodiment of the present invention.

Referring now to FIG. 5 showing various designs of décor cover 115 such as holiday character 504 or seasonal display 508 of the holiday hoop décor system according to an embodiment of the present invention. In one embodiment, décor cover 115 may comprise holiday character 504 such as Santa Clause, Easter Bunny, etc. Alternatively, décor cover 115 may comprise seasonal display 508 such as Uncle Sam, a ghost or other Halloween ensemble, or the like. It should be appreciated that décor cover 115 may comprise a virtually unlimited amount of possibilities.

Figure 6:
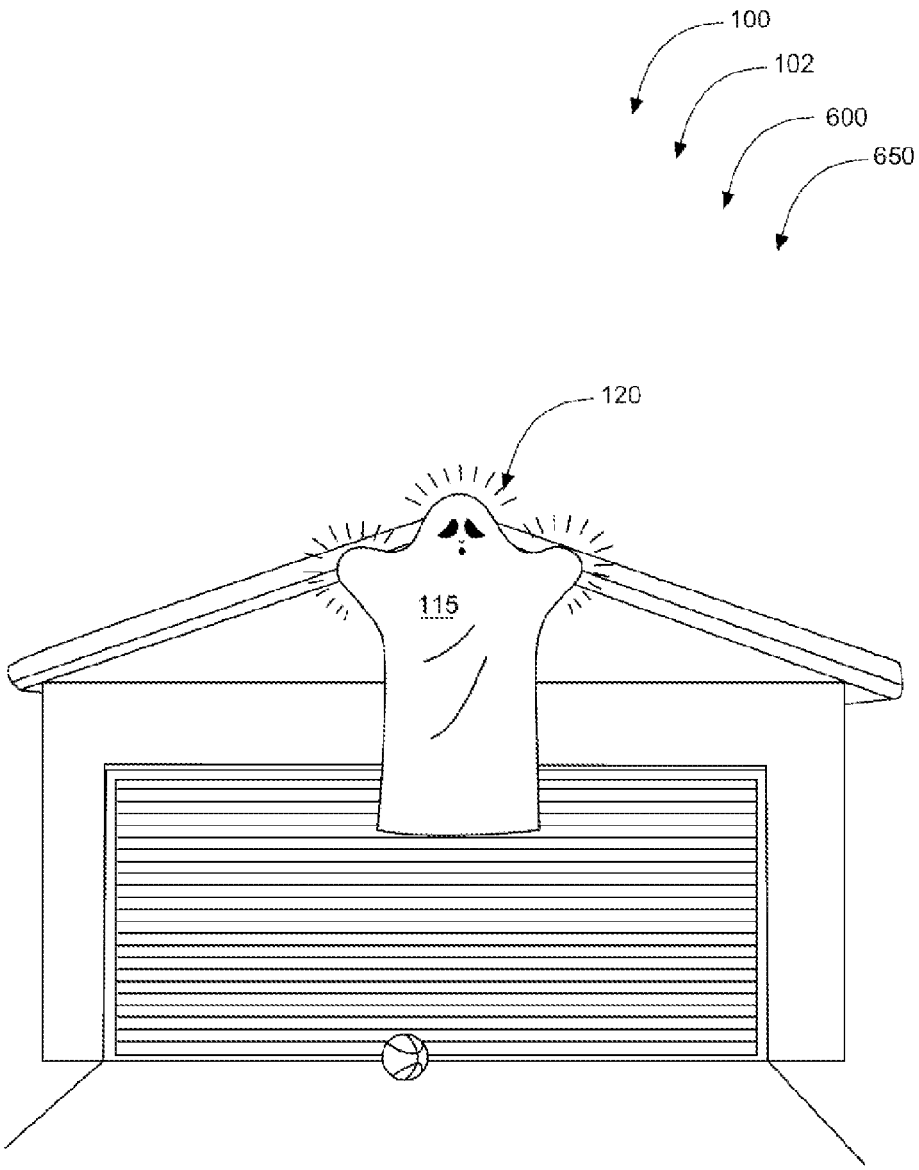
FIG. 6 shows a perspective view illustrating the holiday hoop décor system during an 'in-use' condition comprising the décor support and lighting frame assembly installed to a backboard of a non-in ground basketball hoop according to an embodiment of the present invention.

Referring now to FIG. 6 showing a perspective view illustrating holiday hoop décor systems 100 during 'in-use' condition 650 according to an alternative embodiment of the present invention. As shown, décor support and lighting frame assembly 102 may be installed to backboard 300 of non-in ground basketball hoop 600. In such a manner, holiday hoop décor systems 100 may be used in conjunction with backboard 300 that may be affixed to a planar surface. By way of example, backboard 300 may be affixed above a garage door of a house.

In an embodiment of the present invention, holiday hoop décor systems 100 may comprise a kit which may include décor support and lighting frame assembly 102, at least one cover assembly 110, and at least one set of user instructions. It should be appreciated that user 140 may optionally purchase various versions of décor cover 115 through a retail store or over the internet.

Figure 7:
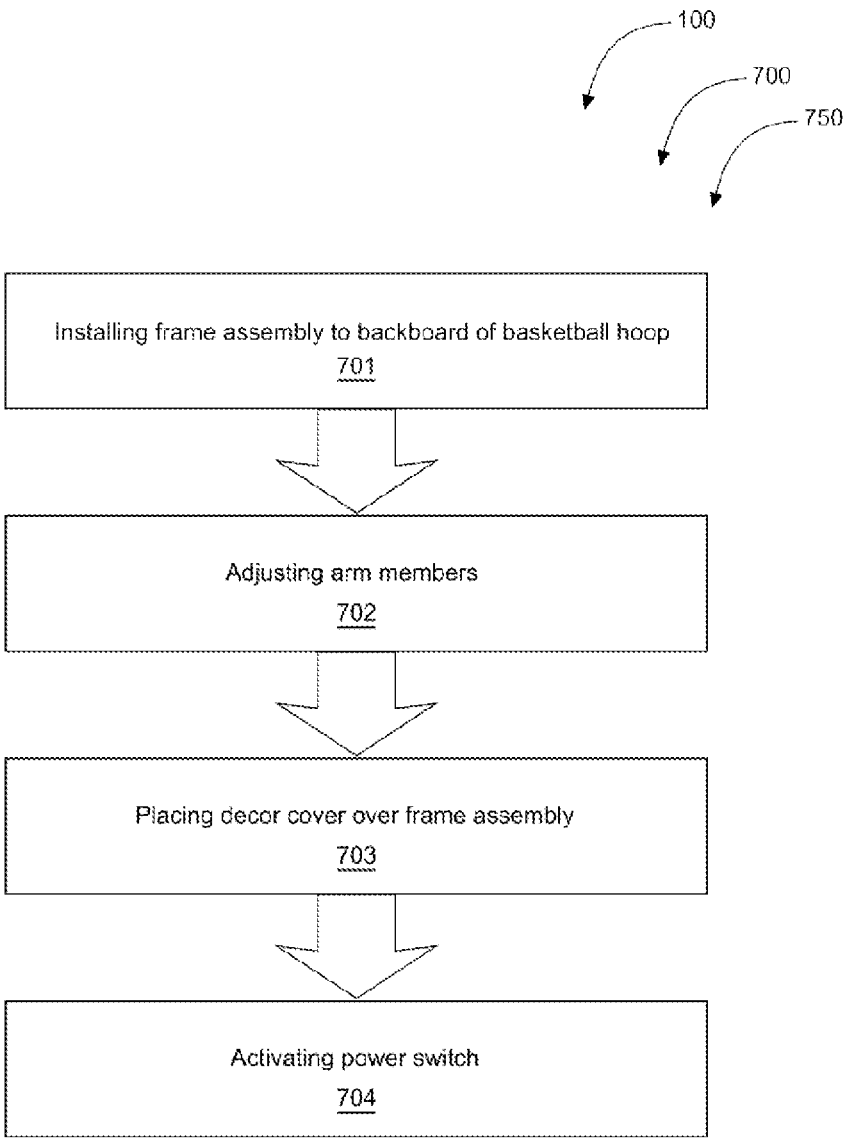
FIG. 7 is a flowchart illustrating a method of use according to an embodiment of the present invention of FIGS. 1-6.

Referring now to FIG. 7, showing flowchart 750 illustrating method of use 700 according to an embodiment of the present invention of FIGS. 1-6. Method of use 700 for holiday hoop décor system 100 may comprise the steps of: step one 701, installing décor support and lighting frame assembly 102 to backboard 300 of basketball hoop 105; step two 702, adjusting first-arm member 202 and second-arm member 216 of décor support and lighting frame assembly 102; step three 703, placing décor cover 115 over décor support and lighting frame assembly 102; and step four 704, activating control switch 280 for illumination 120. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different decorative combinations, parts may be sold separately, etc., may be sufficient.

Some optional steps, not provided for in the accompanying figures, may comprise the steps of removing or replacing décor cover 115 with another embodiment, changing LED 420 of first-arm member light panel 206, second-arm member light panel 220, or head member light panel 236, and folding up décor support and lighting frame assembly 102 for convenient storage during non-use.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A holiday hoop décor system for use with an existing basketball hoop comprising:

a décor support and lighting frame assembly, said décor support and lighting frame assembly comprising;
- a first-arm member comprising;
  - a first-arm member disc;
  - a first-arm member light panel;
  - a first-arm member "T" connector; and
  - a first-arm member pivoter;
- a second-arm member comprising;
  - a second-arm member disc;
  - a second-arm member light panel;
  - a second-arm member "T" connector; and
  - a second-arm member pivoter;
- a head member comprising;
- a head member disc;
  - a head member light panel; and
  - a head member "T" connector;
- a center bar having a first-end, a mid-point, and a second-end;
- a first-frame support having a first-distal end and a first-proximal end;
- a second-frame support having a second-distal end and a second-proximal end;
- a first-frame support retaining strap;
- a first-frame support retaining strap receiver;
- a second-frame support retaining strap;
- a second-frame support retaining strap receiver;
- a plurality of electrical wires; and
- a power plug;
- a control switch; and a cover assembly, said cover assembly comprising;
- a décor-cover; and
- a plurality of fasteners;

wherein said first-arm member has a first-disc-receiving end and a first-connecting end;

wherein said first-disc-receiving end of said first-arm member comprises a first-groove which is slidable into a first-receiving slot of said first-arm member disc;

wherein said first-arm member light panel is integrally installed within a hollow confine of said first-arm member near said first-disc-receiving end;

wherein said first-connecting end of said first-arm member is connectible to said first-end of said center bar via said first-arm member "T" connector;

wherein said first-arm member pivoter enables said first-arm member to pivot left and right about an axis;

wherein said second-arm member has a second-disc-receiving end and a second-connecting end;

wherein said second-disc-receiving end of said second-arm member comprises a second-groove which is slidable into a second-receiving slot of said second-arm member disc;

wherein said second-arm member light panel is integrally installed within a hollow confine of said second-arm member near said second-disc-receiving end;

wherein said second-connecting end of said second-arm member is connectible to said second-end of said center bar via said second-arm member "T" connector;

wherein said second-arm member pivoter enables said second-arm member to pivot left and right about an axis;

wherein said head member has a head-disc-receiving end and a head-connecting end;

wherein said head-disc-receiving end of said head member comprises a head-groove which is slidable into a head-receiving slot of said head member disc;

wherein said head member light panel is integrally installed within a hollow confine of said head member near said head-disc-receiving end;

wherein said head-connecting end of said head member is connectible to said mid-point of said center bar via said head member "T" connector;

wherein said first-proximal end of said first-frame support is connectible to said first-arm member "T" connector such that said first-frame support is perpendicular to said center bar;

wherein said first-frame support retaining strap is attached to said first-distal end of said first-frame support;

wherein said first-frame support retaining strap receiver is attached to said first-arm member "T" connector such that said first-frame support retaining strap receiver is substantially parallel to said first-frame support;

wherein said second-proximal end of said second-frame support is connectible to said second-arm member "T" connector such that said second-frame support is perpendicular to said center bar;

wherein said second-frame support retaining strap is attached to said second-distal end of said second-frame support;

wherein said second-frame support retaining strap receiver is attached to said second-arm member "T" connector such that said second-frame support retaining strap receiver is substantially parallel to said second-frame support;

wherein said electrical wires connects said power plug to said first-arm member light panel;

wherein said electrical wires connects said power plug to said second-arm member light panel;

wherein said electrical wires connects said power plug to said head member light panel;

wherein said control switch activates said power plug;

wherein said power plug provides illuminating power to said first-arm member light panel, said member-arm member light panel, and said head member light panel;

wherein said décor support and lighting frame assembly is installable to a backboard of said existing basketball hoop;

wherein said décor-cover of said cover assembly is securable over said décor support and lighting frame assembly via said plurality of fasteners; and wherein said décor-cover provides a removably installable ornamental display while protecting said backboard of said existing basketball hoop.

2. The holiday hoop décor system of claim 1 wherein said first-frame support and said second-frame support of said décor support and lighting frame assembly comprises padding for protecting said backboard from abrasive contact.

3. The holiday hoop décor system of claim 2 wherein said first-arm member light panel, said second-arm member light panel, and said head member light panel each comprises at least one LED having a clear plastic lens.

4. The holiday hoop décor system of claim 3 wherein said first-arm member disc, said second-arm member disc, and said head member disc are formed of opaque plastic.

5. The holiday hoop décor system of claim 4 wherein said first-receiving slot of said first-arm member disc, said second-receiving slot of said second-arm member disc, and said head-receiving slot of said head member disc each further comprises a nipple.

6. The holiday hoop décor system of claim 5 wherein said nipple serves to guide said first-groove of said first-arm member, said second-groove of said second-arm member, and said head-groove of said head member into said first-receiving slot of said first-arm member disc, said second-receiving slot of said second-arm member disc, and said head-receiving slot of said head member disc respectively.

7. The holiday hoop décor system of claim 6 wherein said first-arm member disc, said second-arm member disc, and said head member disc is lockable and unlockable in place via a clockwise rotation and a counter-clockwise rotation about said nipple respectively.

8. The holiday hoop décor system of claim 7 wherein said first-arm member pivots upwardly approximately 50-60 degrees via said first-arm member pivoter for orienting said first-arm member disc to simulate an appearance of a raised left arm of said décor-cover.

9. The holiday hoop décor system of claim 8 wherein said first-arm member light panel illuminates said décor-cover for simulating a glow around said raised left-arm.

10. The holiday hoop décor system of claim 9 wherein said second-arm member pivots upwardly approximately 50-60 degrees via said second-arm member pivoter for orienting said second-arm member disc to simulate an appearance of a raised right arm of said décor-cover.

11. The holiday hoop décor system of claim 10 wherein said second-arm member light panel illuminates said décor-cover for simulating a glow around said raised right-arm.

12. The holiday hoop décor system of claim 11 wherein said first-arm member and said second-arm member fold upwardly via said first-arm member pivoter and said second-arm member pivoter respectively for compact storage during non-use of said holiday hoop décor system.

13. The holiday hoop décor system of claim 12 wherein said décor support and lighting frame assembly is installable to said backboard that is attached to said basketball hoop having an in-ground support.

14. The holiday hoop décor system of claim 12 wherein said décor support and lighting frame assembly is installable to said backboard that is affixed to a planar surface.

15. The holiday hoop décor system of claim 12 wherein said décor-cover comprises rip-stop nylon.

16. The holiday hoop décor system of claim 15 wherein décor-cover comprises a holiday character.

17. The holiday hoop décor system of claim 15 wherein said décor-cover comprises a seasonal display.

18. A holiday hoop décor system for use with a backboard of a basketball hoop comprising:

- a décor support and lighting frame assembly, said décor support and lighting frame assembly comprising;
  - a first-arm member comprising;
    - a first-arm member disc comprising opaque plastic;
    - a first-arm member light panel comprising at least one LED having a clear plastic lens;
    - a first-arm member "T" connector; and
    - a first-arm member pivoter;
  - a second-arm member comprising;
    - a second-arm member disc comprising opaque plastic;
    - a second-arm member light panel comprising said at least one LED having said clear plastic lens;
    - a second-arm member "T" connector; and
    - a second-arm member pivoter;
  - a head member comprising;
    - a head member disc comprising opaque plastic;
    - a head member light panel comprising said at least one LED having said clear plastic lens; and
    - a head member "T" connector;
  - a center bar having a first-end, a mid-point, and a second-end;
  - a first-frame support comprising a padding having a first-distal end and a first-proximal end;
  - a second-frame support comprising said padding having a second-distal end and a second-proximal end;
  - a first-frame support retaining strap;
  - a first-frame support retaining strap receiver;
  - a second-frame support retaining strap;
  - a second-frame support retaining strap receiver;
  - a plurality of electrical wires; and
  - a power plug;
  - a control switch; and
- a cover assembly, said cover assembly comprising;
  - a décor-cover comprising rip-stop nylon; and
  - a plurality of fasteners;

wherein said first-arm member has a first-disc-receiving end and a first-connecting end;

wherein said first-disc-receiving end of said first-arm member comprises a first-groove which is slidable into a first-receiving slot of said first-arm member disc, said first-receiving slot further comprising a nipple, said nipple serving to guide said first-groove of said first-arm member into said first-receiving slot of said first-arm member disc;

wherein said first-arm member disc is lockable and unlockable in place via a clockwise rotation and a counter-clockwise rotation about said nipple respectively;

wherein said first-arm member light panel is integrally installed within a hollow confine of said first-arm member near said first-disc-receiving end;

wherein said first-arm member pivots upwardly approximately 50-60 degrees via said first-arm member pivoter for orienting said first-arm member disc to simulate an appearance of a raised left arm of said décor-cover;

wherein said first-arm member light panel illuminates said décor-cover for simulating a glow around said raised left-arm;

wherein said first-connecting end of said first-arm member is connectible to said first-end of said center bar via said first-arm member "T" connector;

wherein said first-arm member pivoter enables said first-arm member to pivot left and right about an axis;

wherein said second-arm member has a second-disc-receiving end and a second-connecting end;

wherein said second-disc-receiving end of said second-arm member comprises a second-groove which is slidable into a second-receiving slot of said second-arm member disc, said second-receiving slot further comprising said nipple serving to guide said second-groove of said second-arm member into said second-receiving slot of said second-arm member disc;

wherein said second-arm member disc is lockable and unlockable in place via said clockwise rotation and said counter-clockwise rotation about said nipple respectively;

wherein said second-arm member light panel is integrally installed within a hollow confine of said second-arm member near said second-disc-receiving end;

wherein said second-arm member pivots upwardly approximately 50-60 degrees via said second-arm member pivoter for orienting said second-arm member disc to simulate an appearance of a raised right arm of said décor-cover;

wherein said second-arm member light panel illuminates said décor-cover for simulating a glow around said raised right-arm;

wherein said second-connecting end of said second-arm member is connectible to said second-end of said center bar via said second-arm member "T" connector;

wherein said second-arm member pivoter enables said second-arm member to pivot left and right about an axis;

wherein said head member has a head-disc-receiving end and a head-connecting end;

wherein said head-disc-receiving end of said head member comprises a head-groove which is slidable into a head-receiving slot of said head member disc, said head-receiving slot further comprising said nipple serving to guide said head-groove of said head member into said head-receiving slot of said head member disc;

wherein said head member disc is lockable and unlockable in place via said clockwise rotation and said counter-clockwise rotation about said nipple respectively;

wherein said head member light panel is integrally installed within a hollow confine of said head member near said head-disc-receiving end;

wherein said head-connecting end of said head member is connectible to said mid-point of said center bar via said head member "T" connector;

wherein said first-proximal end of said first-frame support is connectible to said first-arm member "T" connector such that said first-frame support is perpendicular to said center bar;

wherein said first-frame support retaining strap is attached to said first-distal end of said first-frame support;

wherein said first-frame support retaining strap receiver is attached to said first-arm member "T" connector such that said first-frame support retaining strap receiver is substantially parallel to said first-frame support;

wherein said second-proximal end of said second-frame support is connectible to said second-arm member "T" connector such that said second-frame support is perpendicular to said center bar;

wherein said second-frame support retaining strap is attached to said second-distal end of said second-frame support;

wherein said second-frame support retaining strap receiver is attached to said second-arm member "T" connector such that said second-frame support retaining strap receiver is substantially parallel to said second-frame support;

wherein said electrical wires connects said power plug to said first-arm member light panel;

wherein said electrical wires connects said power plug to said second-arm member light panel;

wherein said electrical wires connects said power plug to said head member light panel;

wherein said control switch activates said power plug;

wherein said power plug provides illuminating power to said first-arm member light panel, said member-arm member light panel, and said head member light panel;

wherein said first-arm member light panel, said second-arm member light panel, and said head member light panel each comprises at least one LED having a clear plastic lens;

wherein said first-arm member disc, said second-arm member disc, and said head member disc are formed of opaque plastic;

wherein said décor support and lighting frame assembly is installable to said backboard of said existing basketball hoop;

wherein said décor-cover of said cover assembly is securable over said décor support and lighting frame assembly via said plurality of fasteners; and wherein said décor-cover provides a removably installable ornamental display while protecting said backboard of said basketball hoop.

19. The holiday hoop décor system of claim 18 comprising a kit including at least one said décor support and lighting frame assembly and at least one said cover assembly.

20. A method of use for the holiday hoop decor system of claim 1, the method comprising:

installing the decor support and lighting frame assembly to a backboard of a basketball hoop;

adjusting the first-arm member and the second-arm member of said decor support and lighting frame assembly;

placing the decor cover over said decor support and lighting frame; and activating the control switch for illumination.

* * * * *